US009837227B2

(12) United States Patent
Tseng et al.

(10) Patent No.: US 9,837,227 B2
(45) Date of Patent: Dec. 5, 2017

(54) LOCKING STRUCTURE AND SYSTEM USING THE SAME

(71) Applicant: ABILITY ENTERPRISE CO., LTD., New Taipei (TW)

(72) Inventors: Cheng-Kuang Tseng, New Taipei (TW); Yi-Tong Wang, New Taipei (TW); Chen-Kang Ma, New Taipei (TW)

(73) Assignee: ABILITY ENTERPRISE CO., LTD., New Taipei (TW)

( * ) Notice: Subject to any disclaimer, the term of this patent is extended or adjusted under 35 U.S.C. 154(b) by 14 days.

(21) Appl. No.: 15/233,986

(22) Filed: Aug. 11, 2016

(65) Prior Publication Data

US 2017/0048995 A1 Feb. 16, 2017

(30) Foreign Application Priority Data

Aug. 14, 2015 (TW) ..... 104126553 A

(51) Int. Cl.
*H01H 13/68* (2006.01)
*H01H 13/72* (2006.01)
*H01H 9/26* (2006.01)

(52) U.S. Cl.
CPC ..... *H01H 13/68* (2013.01); *H01H 9/26* (2013.01); *H01H 13/72* (2013.01)

(58) Field of Classification Search
CPC ..... H01H 13/68; H01H 13/72; H01H 13/74
See application file for complete search history.

(56) References Cited

U.S. PATENT DOCUMENTS 1,424,402 A * 8/1922 Hartman ..... H01H 13/20 200/468
5,045,647 A * 9/1991 Kato ..... H01H 13/74 200/5 E
5,329,080 A * 7/1994 Pierce ..... H01H 13/62 200/5 B
5,646,382 A * 7/1997 Moriya ..... H01H 13/72 200/5 E
5,932,854 A * 8/1999 Umemura ..... H01H 13/72 200/5 B
5,965,854 A * 10/1999 Umemura ..... H01H 13/74 200/5 E
5,994,652 A * 11/1999 Umemura ..... H01H 9/0066 200/5 B
9,392,712 B2 * 7/2016 Huang ..... H05K 5/061
2014/0043732 A1 * 2/2014 McKay ..... H02B 1/04 361/622
2014/0355223 A1 * 12/2014 Huang ..... H05K 5/061 361/736

* cited by examiner

*Primary Examiner* — Adrian S Wilson
(74) *Attorney, Agent, or Firm* — McClure, Qualey & Rodack, LLP

(57) ABSTRACT

A locking structure and a system using the same are provided. The locking structure includes a rotating unit, a first switch, a sheet and a second switch. The sheet includes a recess and contact to the first switch or the rotating unit. The second switch includes a protrusion movably disposed within the recess.

20 Claims, 4 Drawing Sheets

LOCKING STRUCTURE AND SYSTEM USING THE SAME

This application claims the benefit of Taiwan application Serial No. 104126553, filed Aug. 14, 2015, the subject matter of which is incorporated herein by reference.

BACKGROUND OF THE INVENTION

Field of the Invention

The invention relates in general to a locking structure and a system using the same, and more particularly to a locking structure which may synchronously move and a system using the same.

Description of the Related Art

The electronic device is usually provided with a receiving recess on the casing or with an opening for receiving the connecting port. Hence, a switch structure or a locker structure which can enclose the receiving recess or the opening may be disposed on the receiving recess or the opening. In general, the switch structure or the locker structure may be connected to the casing of the electronic device, and may be engaged with the casing in accordance with elements on the switch structure or the locker structure so as to enclose the receiving recess or the opening for receiving the connecting port.

However, the elements on the switch structure or the locker structure are generally exposed outside the electronic device. Therefore, the switch structure or the locker structure may likely be detached from the casing unexpectedly, so that the receiving recess or the opening for receiving the connecting port may be exposed.

Therefore, it is desired to provide a novel locking structure so as to prevent the switch structure or the locker structure from opening unexpectedly or easily.

SUMMARY OF THE INVENTION

The invention is directed to a locking structure and an electronic system using the same capable of preventing the locking structure from opening unexpectedly.

According to one embodiment of the present invention, a locking structure is provided. The locking structure includes a rotating unit, a first switch, a sheet and a second switch. The sheet includes a recess and contact to the first switch or the rotating unit. The second switch includes a protrusion movably disposed within the recess.

According to another embodiment of the present invention, an electronic system is provided. The electronic system includes an electronic device and a locking structure. The locking structure includes a rotating unit, a first switch, a sheet and a second switch. The sheet includes a recess and contact to the first switch or the rotating unit. The second switch includes a protrusion movably disposed within the recess. The locking structure further includes a base pivotally connected with the electronic device.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1A:
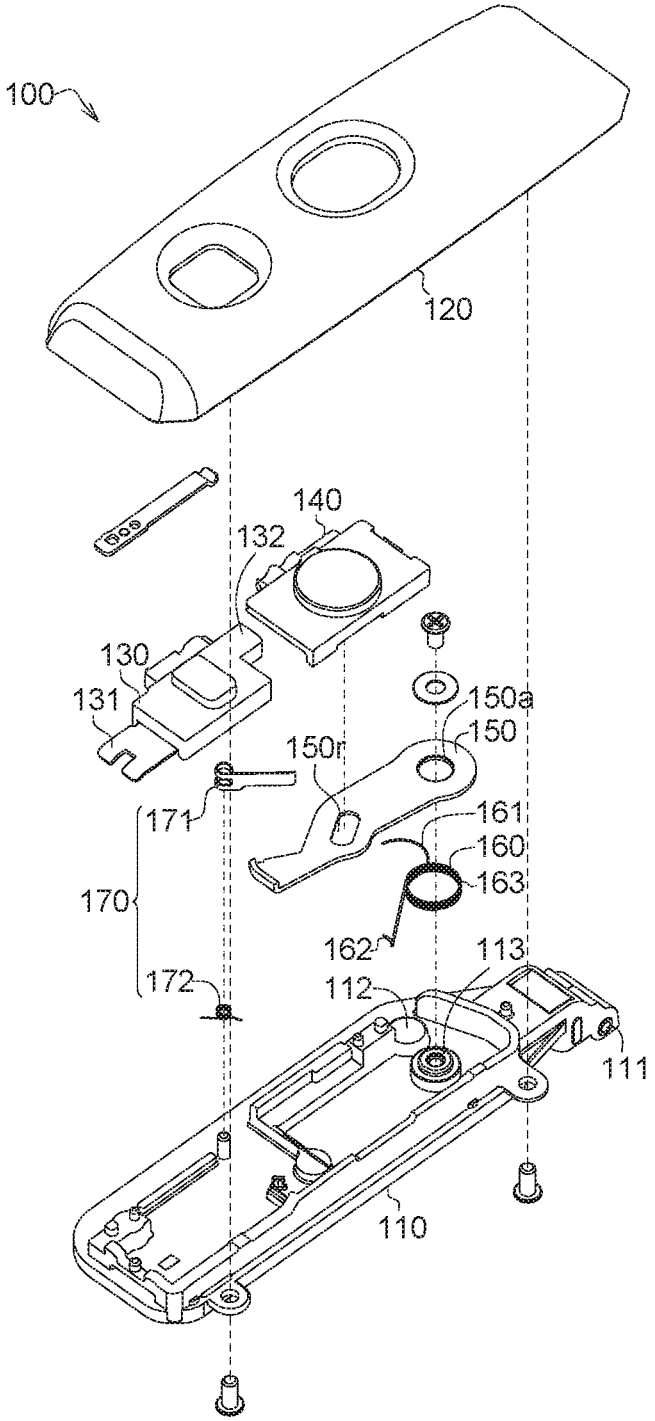
FIG. 1A is an explosion diagram of a locking structure according to one embodiment of the present invention.
Figure 1B:
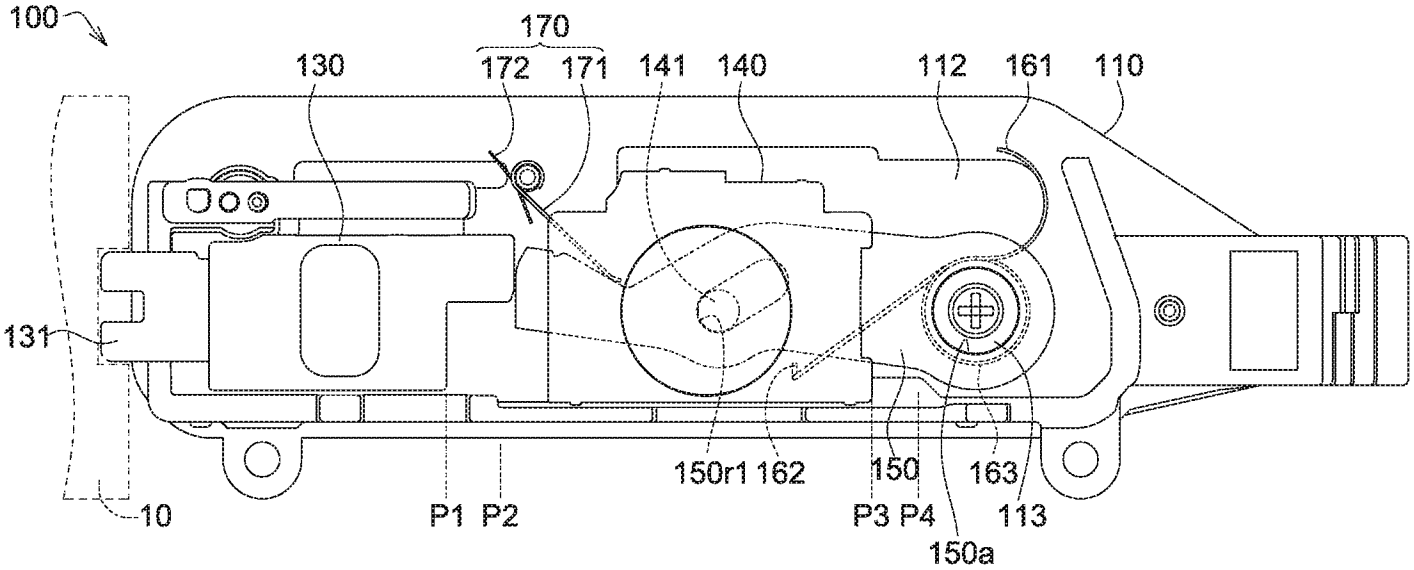
FIG. 1B is an assembly diagram of the locking structure of FIG. 1A.

FIG. 1A is an explosion diagram of a locking structure 100 according to one embodiment of the present invention. FIG. 1B is an assembly diagram of the locking structure 100 of FIG. 1A. The locking structure 100 mainly includes a base 110, a casing 120, a first switch 130, a second switch 140, a sheet 150, a first elastic element 160 and a rotating unit 170.

The locking structure 100 may be connected with an electronic device (not shown) to construct an electronic system. The electronic device may be a mobile communication device, a camera, a video camera, a tablet, a notebook, etc., but the present invention is not limited thereto.

Figure 2:
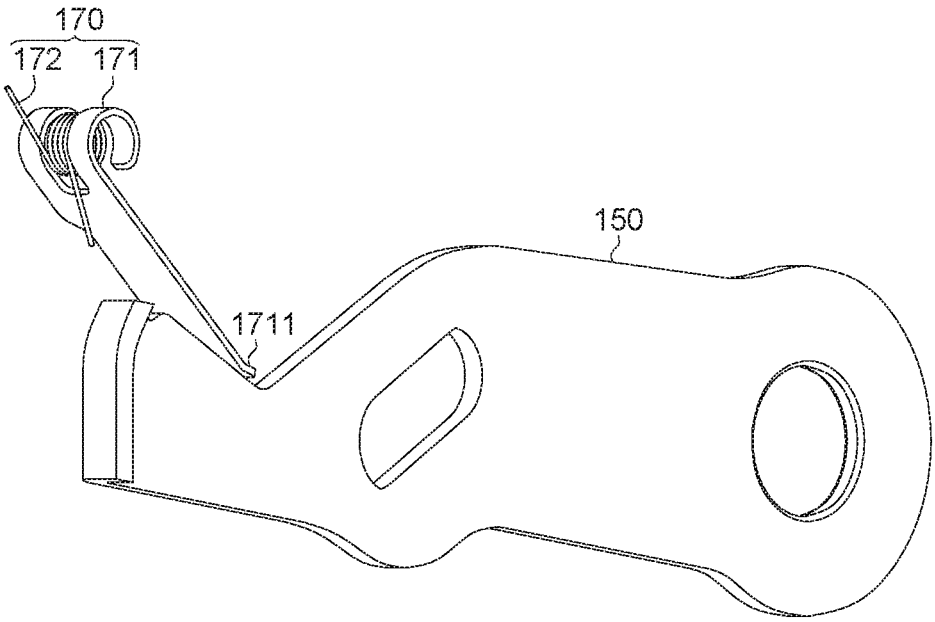
FIG. 2 is a schematic diagram of a rotating unit and a sheet according to the embodiment of the present invention.

FIG. 2 is a schematic diagram of the rotating unit 170 and the sheet 150 according to the embodiment of the present invention. As shown in FIGS. 1A, 1B and 2, the base 110 and the casing 120 may construct a receiving space. The first switch 130, the second switch 140, the sheet 150, the first elastic element 160 and the rotating unit 170 may be disposed between the base 110 and the casing 120. Further, the base 110 includes a pivot 111, a fixed component 112 and a pillar 113. The base 110 and the electronic device may be pivotally connected with the pivot 111 so as to construct the electronic system, and the base 110 may rotate relatively with the electronic device. The fixed component 112 may contact to the first elastic element 160, and the first elastic element 160 may be disposed around the pillar 113.

As shown in FIG. 1B, the first switch 130 is at a first position P1, and the second switch 140 is at a third position P3. When the first switch 130 is at the first position P1, the first switch 130 may be contacted to the body 10 of the electronic device. For example, the first switch 130 may be locked, fastened, connected or engaged to the body 10 of the electronic device in accordance with the locking part 131 of the first switch 130, but the present invention is not limited. When the second switch 140 is at the third position P3, the sheet 150 may contact to and stop the first switch 130 moving towards the second switch 140.

The sheet 150 is pivotally connected to the base 110. For instance, the base 110 may further include a pillar 113. The sheet 150 may include an opening 150*a*, and the opening 150*a* of the sheet 150 is disposed around the pillar 113. The sheet 150 may rotate relatively with the base 110 in accordance with the opening 150*a* and the pillar 113 used as a rotating shaft. For example, the sheet 150 may be a bar, a shaft, a strip-shaped, etc., but the present invention is not limited thereto.

Referring to FIGS. 1A and 1B at the same time, the first elastic element 160 includes a first portion 161, a second portion 162 and a third portion 163. The first portion 161 of first elastic element 160 abuts the fixed component 112 of the base 110. The second portion 162 may contact or may not contact to the sheet 150 according to the relative rotation between the sheet 150 and the base 110. For example, the second portion 162 may abut or connect to the sheet 150, but the present invention is not limited thereto. The third portion 163 is disposed between the first portion 161 and the second portion 162. In one embodiment, the first portion 161 may be curved, tip or hooked shape. The fixed component 112 may be a protrusion or a column which the first portion 161 may be fixed to by way of hook, fitting or insertion. When the second portion 162 of the first elastic element 160 does not abut or not connect to the sheet 150, the first elastic element 160 is in a free state. The third portion 163 of the first elastic element 160 may be concentrically wound into a ring or curved shape. The third portion 163 of the first elastic element 160 may be disposed around the pillar 113 of the base 110. The first elastic element 160 may be a torsion spring.

As shown in FIGS. 1B and 2, the rotating unit 170 mainly includes a rod 171 and a second elastic element 172. Two ends of the second elastic element 172 connect with the base 110 and the rod 171, respectively. Specifically, one end of the rod 171 (not shown) may be rotatably disposed on the base 110 and thus used as a rotating shaft (not shown). The second elastic element 172 may be disposed around the end of the rod 171. Thus, if the rod 171 rotates, the second elastic element 172 may deform and apply a second elastic force to the rod 171 accordingly. Meanwhile, another end of the rod 171 (not shown) may contact to the sheet 150. Alternatively, another end of the rod 171 (not shown) may abut the sheet 150, but the present invention is not limited thereto. The end of the rod 171 used as the rotating shaft may be formed in hooked or columnar structure. The second elastic element 172 may be a torsion spring, while the hooked or columnar structure of the rod 171 may fix the position of the second elastic element 172.

Figure 3:
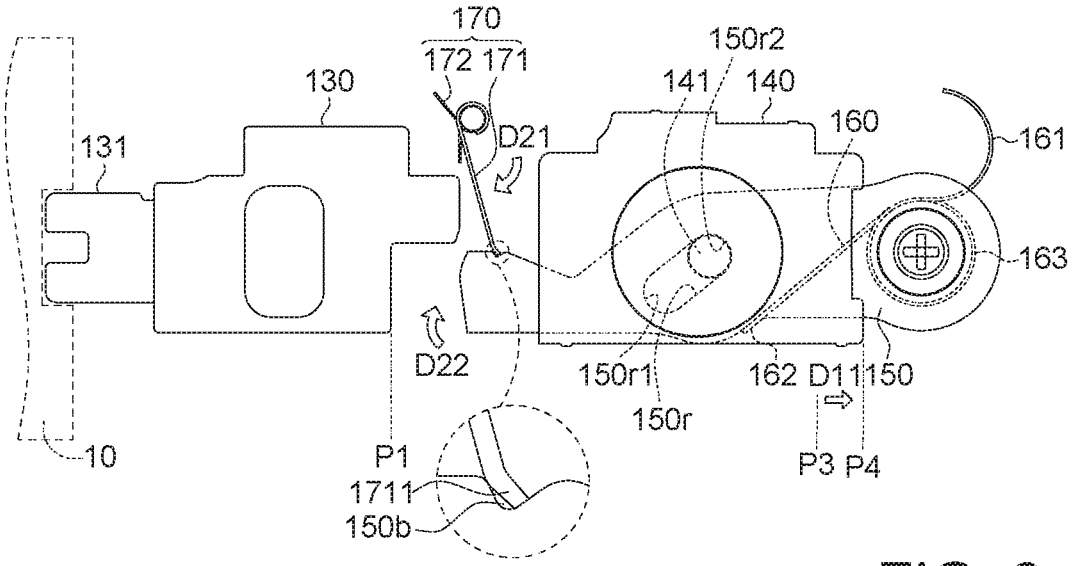
FIG. 3 is a schematic diagram of a first switch at a first position and a second switch at a fourth position according to the embodiment of the present invention.
Figure 4:
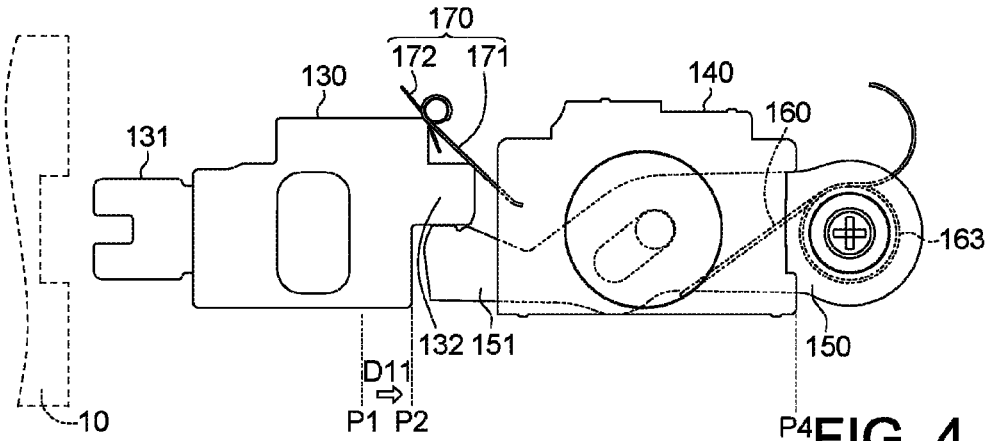
FIG. 4 is a schematic diagram of the first switch at a second position and the second switch at the fourth position according to the embodiment of the present invention.
Figure 5:
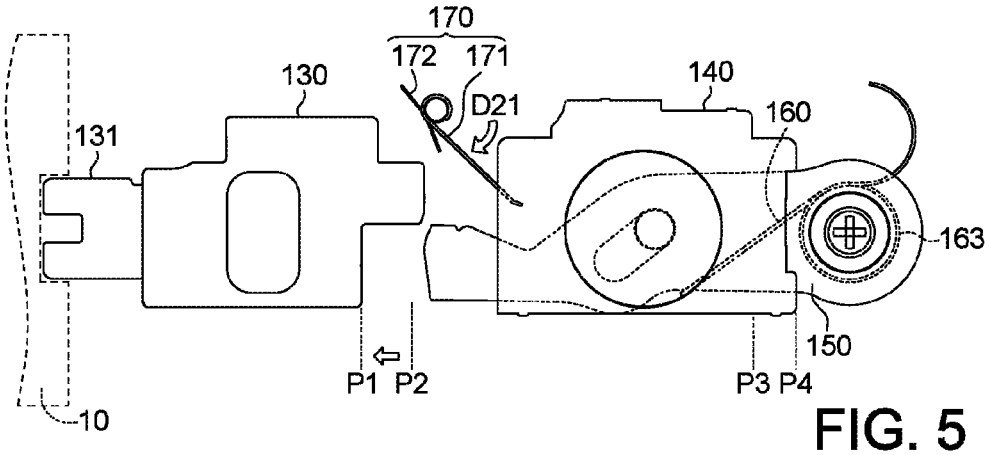
FIG. 5 is a schematic diagram of the first switch at the first position and the second switch at the fourth position according to the embodiment of the present invention.
Figure 6:
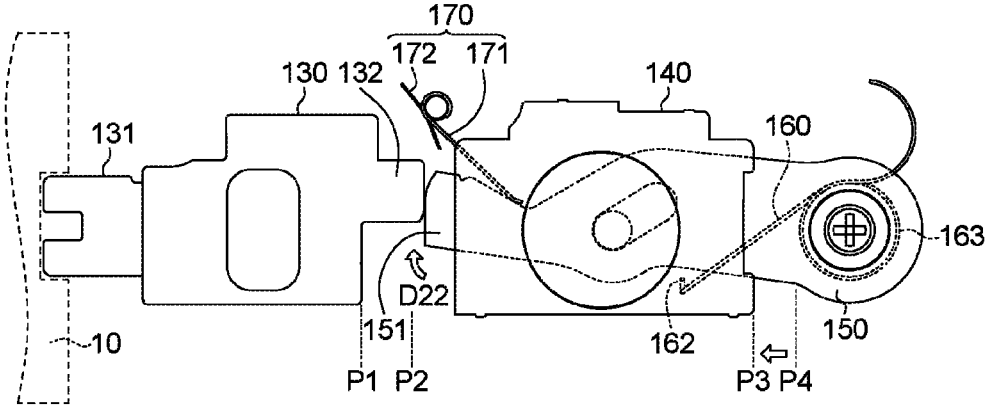
FIG. 6 is a schematic diagram of the first switch at the first position and the second switch at a third position according to the embodiment of the present invention.

FIG. 3 is a schematic diagram of the first switch 130 at the first position P1 and the second switch 140 at a fourth position P4 according to the embodiment of the present invention. FIG. 4 is a schematic diagram of the first switch 130 at a second position P2 and the second switch 140 at the fourth position P4 according to the embodiment of the present invention. FIG. 5 is a schematic diagram of the first switch 130 at the first position P1 and the second switch 140 at the fourth position P4 according to the embodiment of the present invention. FIG. 6 is a schematic diagram of the first switch 130 at the first position P1 and the second switch 140 at the third position P3 according to the embodiment of the present invention.

Referring to FIGS. 3 and 6 at the same time, the sheet 150 selectively contacts to the first switch 130. The sheet 150 further includes a stopper portion 151. During the period when the second switch 140 moves from the third position P3 to the fourth position P4 along a translational direction D11, the sheet 150 may rotate along a direction reverse to the second rotational direction D22 in accordance with the second switch 140. That is, the stopper portion 151 of the sheet 150 and the rotating unit 170 move away from each other. Meanwhile, the first elastic element 160 may deform due to the rotation of the sheet 150, and thus apply a first elastic force to the sheet 150. The first elastic force substantially applies force to the sheet 150 in the second rotational direction D22. The second rotational direction D22 may be the rotational direction of the sheet 150, wherein the direction where the sheet 150 moves close to the rotating unit 170 is a forward direction, while the direction where the sheet 150 moves away from the rotating unit 170 is a reverse direction.

As shown in FIG. 3, the sheet 150 has a notch 150*b*. The rod 171 of the rotating unit 170 is selectively contacted to the notch 150*b*, and the rod 171 further has an end 1711. In other words, the end 1711 of the rod 171 further contacts to the notch 150*b*. When the sheet 150 rotates along the reverse direction of the second rotational direction D22, the rod 171 may rotate along a forward direction of a first rotational direction D21 with the aid of the second elastic force of the second elastic element 172, so that the end 1711 of the rod 171 may be contacts to the notch 150*b* of the sheet 150. The first rotational direction D21 may be the rotational direction of the rotating unit 170, wherein the direction where the rotating unit 170 moves close to the first switch 130 is a forward direction, while the direction where the rotating unit 170 moves away from the first switch 130 is a reverse direction.

As shown in FIG. 3 and the enlarged view thereof. For example, the end 1711 of the rod 171 may be engaged with the notch 150*b* of the sheet 150 so as to fix the rod 171. Hence, the sheet 150 may be stopped rotating along the forward direction of the second rotational direction D22.

Specifically, as shown in FIG. 3 to FIG. 6, the sheet 150 includes a recess 150*r*, and the second switch 140 includes a protrusion 141 which may be disposed within the recess 150*r*. The recess 150*r* has a first end 150*r*1 and a second end 150*r*2. The protrusion 141 of the second switch 140 may move between the first end 150*r*1 and the second end 150*r*2 of the recess 150*r*. Thus, the second switch 140 is at the third position P3 or the fourth position P4 in accordance with the protrusion 141 of the second switch 140 disposed at the first end 150*r*1 or the second end 150*r*2 of the recess 150*r*. For example, when the first switch 130 is at the first position P1, the protrusion 141 of the second switch 140 is disposed at the first end 150*r*1 or the second end 150*r*2 of the recess 150*r*. Further, when the protrusion 141 of the second switch 140 is disposed at the first end 150*r*1, the sheet 150 contacts to the first switch 130. When the protrusion 141 of the second switch 140 is disposed at the second end 150*r*2, the end 1711 of the rod 171 is contact to the notch or the first switch 130 contact to the sheet 150 and the rotating unit 170. The sheet 150 may rotate along the second rotational direction D22 in accordance with the protrusion 141 and the recess 150*r*. In other words, when the second switch 140 moves along the translational direction D11, the protrusion 141 of the second switch 140 may move between the first end 150*r*1 and the second end 150*r*2 of the recess 150*r*, so that the sheet 150 may rotate along the second rotational direction D22.

Referring to FIGS. 3 and 4 at the same time, when the second switch 140 is at the fourth position P4, the first switch 130 may be moved from the first position P1 to the second position P2 along the translational direction D11, thereby the first switch 130 may move away from the body 10 of the electronic device. In other words, the locking part 131 of the first switch 130 does not contact to the body 10 of the electronic device. If the first switch 130 is at the second position P2, the first switch 130 contacts to the rotating unit 170 and the sheet 150. In other words, the first switch 130 further abuts the rotating unit 170 and the sheet 150. And thereby the limiting portion 132 of the first switch 130 may push the end 1711 of the rod 171. Hence, the end 1711 may be detached from the notch 150*b* of the sheet 150, thereby releasing the engaging relationship between the rotating unit 170 and the sheet 150. And the rotating unit 170 may be separated from the sheet 150 in accordance with the first switch 130. Meanwhile, the limiting portion 132 locates between the stopper portion 151 and the rotating unit 170, thereby preventing the sheet 150 from rotating along the forward direction of the second rotational direction D22. Further, even though the first elastic force of the first elastic element 160 may force the sheet 150 to rotate along the forward direction of the second rotational direction D22, the sheet 150 and the first switch 130 still remain in the original relative position in that the limiting portion 132 and the stopper portion 151 connect with each other.

As shown in FIGS. 4 and 5, during the period when the first switch 130 moves from the second position P2 to the first position P1, the sheet 150 may rotate along the forward direction of the second rotational direction D22 with the aid of the first elastic force of the first elastic element 160 since the limiting portion 132 of the first switch 130 and the stopper portion 151 of the sheet 150 move away from each other. Meanwhile, the second switch 140 is driven to move towards the third position P3.

As shown in FIGS. 5 and 6, when the second switch 140 is at the third position P3, the stopper portion 151 of the sheet 150 contacts to the surface of the limiting portion 132 of the first switch 130, so that the first switch 130 remains at the first position P1. Alternatively, the stopper portion 151 of the sheet 150 may abut or connect with the surface of the limiting portion 132 of the first switch 130, but the present invention is not limited thereto.

As shown in FIG. 6, when the first switch 130 is at the first position P1, the second elastic force of the second elastic element 172 may drive the rod 171 to rotate along the forward direction of the first rotational direction D21. However, with the cooperation of the first elastic element 160 and the second elastic element 172, the driving force enabling the sheet 150 to rotate along the second rotational direction D22 is larger than the driving force enabling the rotating unit 170 to rotate along the first rotational direction D21, and thereby the first switch 130 is at the first position P1 and the second switch 140 is at the third position P3. In such a circumstance, the locking structure 100 may be pivotally connected with the electronic device firmly so as to construct an electronic system. For example, the locking structure 100 may be realized by implementing the firs elastic element 160 having the first elastic force and the second elastic element 172 having the second elastic force substantially smaller than the first elastic force, or by implementing the first elastic element 160 applying a first torque to the sheet 150 and the second elastic element 172 applying a second torque to the rod 171, and the second torque is substantially smaller than the first torque. In other words, the first elastic force of the first elastic element 160 may be substantially larger than the second elastic force of the second elastic element 172, or the first torque of the first elastic element 160 applied to the sheet 150 may be substantially larger than the second torque of the second elastic element 172 applied to the rod 171 of the rotating unit 170.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A locking structure, comprising:
a rotating unit;
a first switch;
a sheet comprising a recess and contacting to the first switch or the rotating unit; and
a second switch comprising a protrusion movably disposed within the recess.

2. The locking structure according to claim 1, further comprising a base and a first elastic element, the first elastic element disposed on the base and contacting to the sheet.

3. The locking structure according to claim 1, wherein the recess has a first end and a second end, and when the first switch is at a first position, the protrusion of the second switch is disposed at the first end or the second end.

4. The locking structure according to claim 3, wherein when the protrusion of the second switch is at the first end of the recess, the sheet contacts to the first switch.

5. The locking structure according to claim 3, wherein the sheet has a notch, the rotating unit comprises a rod, and when the protrusion of the second switch is at the second end of the recess, an end of the rod is contacted to the notch.

6. The locking structure according to claim 5, wherein the rotating unit further comprises a second elastic element, and one end of the second elastic element contacts to the rod.

7. The locking structure according to claim 6, further comprising a base, wherein another end of the second elastic element contacts to the base.

8. The locking structure according to claim 1, further comprising a first elastic element and a second elastic element, wherein a first elastic force of the first elastic element is substantially larger than a second elastic force of the second elastic element, or a first torque of the first elastic element applied to the sheet is substantially larger than a second torque of the second elastic element applied to the rotating unit.

9. The locking structure according to claim 1, wherein when the first switch is at a second position, the first switch contacts to the rotating unit and the sheet.

10. An electronic system, comprising:
an electronic device; and
the locking structure according to claim 1, further comprising a base pivotally connected with the electronic device.

11. A locking structure, comprising:
a first switch;
a second switch;
a rotating unit comprising a rod; and
a sheet comprising a notch, wherein the sheet contacts to the second switch and selectively contacts to the first switch, and the rod is selectively contacted to the notch.

12. The locking structure according to claim 11, wherein the sheet further comprises a recess with a first end and a second end, the second switch comprises a protrusion, and when the first switch is at a first position, the protrusion of the second switch is disposed at the first end or the second end.

13. The locking structure according to claim 12, wherein when the protrusion of the second switch is at the first end of the recess, the sheet contacts to the first switch.

14. The locking structure according to claim 12, wherein when the protrusion of the second switch is at the second end of the recess, an end of the rod is contacted to the notch.

15. A locking structure, comprising:
a first switch;
a second switch;
a rotating unit; and
a sheet;
wherein when the sheet contacts to the first switch, the second switch is at a third position in accordance with the sheet; and
when the first switch is at a second position, the rotating unit is separated from the sheet in accordance with the first switch.

16. The locking structure according to claim 15, wherein the sheet further comprises a recess with a first end and a second end, the second switch comprises a protrusion, and when the first switch is at a first position, the protrusion of the second switch is disposed at the first end or the second end.

17. The locking structure according to claim 16, wherein when the protrusion of the second switch is at the first end of the recess, the sheet contacts to the first switch.

18. The locking structure according to claim 16, wherein when the protrusion of the second switch is at the second end of the recess, the first switch contacts to the rotating unit and the sheet.

19. The locking structure according to claim 16, wherein the sheet has a notch, the rotating unit has a rod, and when the protrusion of the second switch is at the second end of the recess, the rod is contacted to the notch.

20. The locking structure according to claim 15, wherein the sheet further comprises a recess with a first end and a second end, the second switch comprises a protrusion, and the second switch is at a third position or a fourth position in accordance with the protrusion disposed at the first end or the second end of the recess.

* * * * *